US005237294A

United States Patent [19]

Roederer et al.

[11] Patent Number: 5,237,294

[45] Date of Patent: Aug. 17, 1993

[54] MICROWAVE HYBRID COUPLER HAVING 3×N INPUTS AND 3×M OUTPUTS

[76] Inventors: Antoine Roederer, Breloftpark 32, Noordwijk, Netherlands; Martin P. C. Maximo, Parque de Vergara, 11-B2, 28250 Torrelodones, Spain

[21] Appl. No.: 802,685

[22] Filed: Dec. 5, 1991

[30] Foreign Application Priority Data

Dec. 6, 1990 [FR] France ..... 90 15315

[51] Int. Cl.[5] ..... H01P 5/16

[52] U.S. Cl. ..... 333/117; 333/116; 333/120

[58] Field of Search ..... 333/115-117, 333/120, 123, 128

[56] References Cited

U.S. PATENT DOCUMENTS

| | | | |
|---|---|---|---|
| 2,784,381 | 3/1957 | Rudenbom . | |
| 2,874,276 | 2/1959 | Dukes et al. | 333/120 X |
| 3,086,178 | 4/1963 | Boyd, Jr. | 333/116 X |
| 3,678,415 | 7/1972 | Kuroda | 333/115 X |
| 4,127,832 | 11/1978 | Riblet | 333/116 |
| 4,328,471 | 5/1982 | Quine | 333/128 |

OTHER PUBLICATIONS

Sakagami et al., *A Constant-Resistance Power Divider Using Coupled Lines . . .* , The Trans. of the IECE of Japan, vol. E60, No. 1, Jan. '77, pp. 44, 45.

IEEE Transactions on Microwave Theory and Techniques, vol. 32, No. 1 Jan. 1984, New York US pp. 51-57; D. I. Kim et al.

IEEE MIT-S International Microwave Symposium-Digest of Technical Papers Jun. 14-16, 1976, Cherry Hill, US pp. 63-65.

Microwave Journal, vol. 22, No. 2, Feb. 1979, Dedaham US pp. 51-52, H. C. Chappell.

Multiple Beams from Linear Arrays*, IRE Transactions on Antennas and Propagation, J. P. Shelton.

*Primary Examiner*—Paul Gensler

*Attorney, Agent, or Firm*—Ronald Craig Fish

[57] ABSTRACT

There is disclosed a six-port hybrid microwave coupler comprising three inputs and three outputs which are isolated from each other and matched such that a signal applied to any one of the inputs produces signals on all three of the outputs, said signals being orthogonally distributed in phase and uniformly distributed in amplitude. The coupler has a plane configuration of transmission lines with an inner ring comprising three similar segments with the interconnection points of the segments constituting three input or outlet first ports of the coupler. The coupler also has an outer ring comprising three similar segments with the interconnection points of the segments constituting three outlet or input second ports, respectively, of the coupler. The coupler also has three radial branches connecting the interconnection points of the inner ring segments to corresponding interconnection points of the outer ring.

4 Claims, 2 Drawing Sheets

MICROWAVE HYBRID COUPLER HAVING 3×N INPUTS AND 3×M OUTPUTS

The present invention relates to microwave hybrid couplers.

BACKGROUND OF THE INVENTION

Couplers are generally components that have four accesses or ports, i.e. two inputs and two outputs, where a signal applied to one of the inputs has its power halved and reproduced at both outputs, with the non-fed input being isolated. At the two outputs, the vectors representing complex voltages are orthogonal, i.e. the complex voltages (which have the same amplitude) have a phase relationship that is either in quadrature or else in phase opposition.

In numerous applications, for example such as the multiple beam forming arrays of antennas or amplifiers having multiple ports, it is desirable to have hybrid couplers which, while conserving the above properties of isolation between inputs and of complex voltage vectors at their outputs that are orthogonal, nevertheless possess more than two inputs and two outputs.

Butler matrices and so-called "generalized" couplers are examples of such multipleport couplers.

Such multiple port couplers are generally constituted by elementary four-port hybrid couplers that are combined together by transmission lines. The principles on which they are based means that their numbers of inputs and outputs are always powers of two, and they also include transmission lines that cross over one another, thereby complicating manufacture.

To enlarge the range of possible combinations, it would be desirable to have compact couplers with three inputs and three outputs, the inputs being matched and isolated, and with each of the inputs being capable of delivering a uniform distribution of power to the three outputs, with the power distribution from each input being orthogonal to the distribution from the other two inputs.

Such components would make it possible to extend the structure of generalized couplers by greatly simplifying the implementation of matrices having a number of inputs or of outputs that is a multiple of three, for example 3×3, 6×6, or 9×9, etc. square matrices, or 3×6, 6×3, 3×9, etc. rectangular matrices.

The object of the present invention is to provide such a microwave coupler having three isolated and matched inputs each producing a distribution at the three outputs that is uniform in amplitude and orthogonal to the distributions corresponding to the other two inputs, and also to provide generalized couplers making use of such elementary 3×3 couplers.

The only 3×3 coupler having these properties that has been proposed in the literature is a component described in an article by J. P. Shelton and K. S. Kelleher, entitled "Multiple beams from linear arrays", published in IRE Transactions on Antennas and propagation, March 1961, pp. 154–161, and in particular Appendix I, pp. 158–160, entitled "Six-port junction for multiple-feed arrays".

That coupler, which is shown diagrammatically in FIG. 1, has three inputs 1, 3, and 5, and three outputs 2, 4, and 6 interconnected essentially by components referenced 20, namely three transmission lines 21 disposed symmetrically and interconnected transversely by two series of crossmembers 22 and 23; in the zone lying between the components 21, 22, and 23, this configuration establishes square coupling regions that distribute power between the three lines 21. To ensure that the phases of the signals at the three outputs 2, 4, and 6 are at mutual uniform phase differences of 120°, a phase shifter circuit 24 is inserted in one of the lines. This circuit 24 which adds a phase shift of 120° thus makes it possible to obtain the looked-for phase relationship between the outputs.

This type of coupler has hardly been used in practice, and it suffers from several drawbacks, in particular excessive bulk, and manufacturing difficulties because of the difficulties in dimensioning the various components (on which topic the above-mentioned article is silent), with a correspondingly high cost.

In addition, because of its threedimensional configuration, such a coupler necessitates the use of coaxial line technology or waveguide technology, thereby limiting the situations in which it can be used, or else requiring interfacing with transmission lines made using some other technology, thereby increasing difficulties in implementation and in development.

The present invention seeks to remedy these drawbacks by providing a 3×3 coupler of the above-specified type but made using a configuration that is essentially plane, thus lending itself to being implemented using a wide variety of technologies such as microstrip, stripline, square coaxial line, called "bar line", etc.

SUMMARY OF THE INVENTION

To this end, the present invention provides a six-port hybrid microwave coupler comprising three inputs and three outputs that are isolated and matched, where a signal applied to any one of the inputs produces signals on all three outputs with equal amplitudes and with phases such that the three sets of output signals, or complex vectors, corresponds to the three inputs where each output signal is distributed in phase relative to the other output signals; the coupler having a plane configuration of transmission lines comprising: an inner ring comprising three similar segments with the interconnection points of said segments constituting three input or output first ports of the coupler; an outer ring comprising three similar segments with the interconnection points of said segments constituting three output or input second ports respectively of said coupler; and three radial branches connecting the interconnection points of the inner ring segments to corresponding interconnection points of the outer ring.

In a first embodiment, for a guided wavelength of $\lambda$, and for lengths expressed in terms of modulo $\lambda$, with Zo being the characteristic impedance of the input and outlet lines, the segments of the inner ring segments are of length $\lambda/3$ and of characteristic impedance Zo, the outer ring segments are of length $\lambda/3$ or $4\lambda/3$ and of characteristic impedance Zo, and the radial branches are of length $\lambda/12$ and of characteristic impedance Zo.

Advantageously, in order to enlarge the pass band of the coupler, additional radial branches may be provided connecting the inner ring to the outer ring at points which are situated in intermediate regions between the respective interconnection points thereof.

The invention also extends to a generalized hybrid microwave coupler having 3×N inputs and 3×M outputs that are isolated and matched, N and M being natural integers, in which a signal applied to any one of the 3×N inputs produces a uniform distribution of signals over the 3×M outputs, in which for N and M greater than 1, the generalized coupler is constituted by a combination of a plurality of 3×3 elementary couplers of the type specified above, optionally together with conventional 2×2 type couplers.

BRIEF DESCRIPTION OF THE DRAWINGS

Embodiments of the invention are described by way of example with reference to the accompanying drawings, in which.

Above-mentioned

DETAILED DESCRIPTION

As a preliminary point, it is specified that the references 1 to 18 are used in all of the figures to designate the various different ports of a coupler regardless of the particular embodiment shown; by convention, odd numbers designate inputs and even numbers designate outputs.

In contrast, the other numerical references designate items having similar functions from one figure to another.

Figure 1:
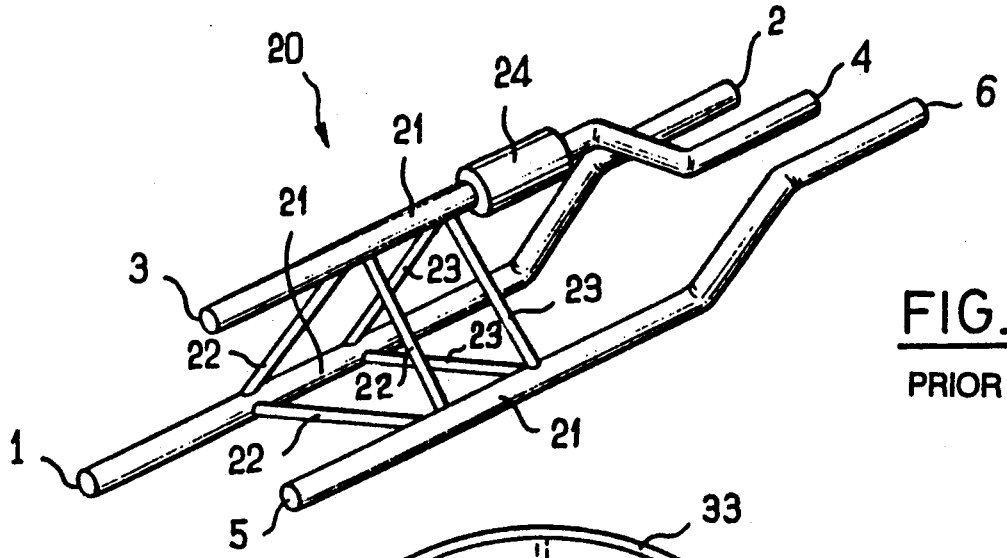
FIG. 1 PRIOR ART
FIG. 1 is a diagram of a prior art 3×3 coupler.
Figure 2:
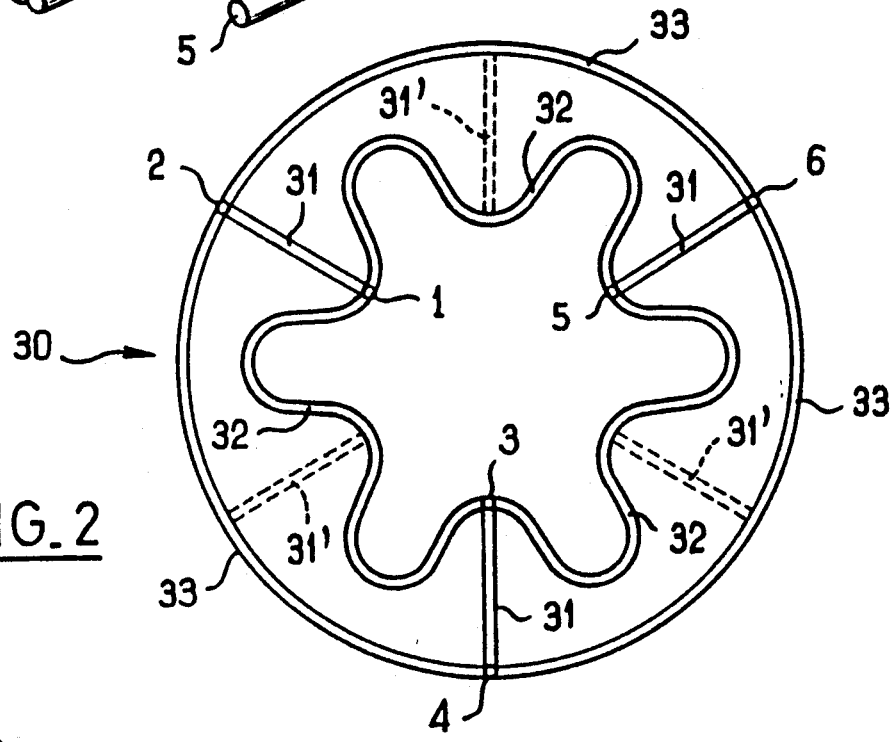
FIG. 2 is a plan view of a 3×3 coupler of the invention.

FIG. 2 is a diagrammatic plan view of a coupler 30 of the invention. The coupler essentially comprises three radial branches 31 at uniform angular spacing connecting inputs 1, 3, and 5 of the coupler to respective corresponding outputs 2, 4, and 6 thereof. Moreover, the inputs 1, 3, and 5 are interconnected by an inner ring constituted by three similar segments 32, while the outputs 2, 4, and 6 are interconnected by an outer ring comprising three similar segments 33. In addition, to widen the pass band of the coupler, further radial branches 31' may be added connecting the inner ring to the outer ring at points thereof situated in intermediate regions between the respective junction points.

With such a configuration, a microwave signal applied to any one of the inputs 1, 3, or 5 reappears at all three outputs 2, 4, and 6 with nominally equal amplitudes. Two of the output phases are equal and the third is nominally at 120° relative to the other two. The other two, non-used inputs are nominally decoupled. From the impedance point of view, the entire component is nominally matched.

In other words, when each of the three inputs 1, 3 and 5 in FIG. 2 are excited with a unit voltage periodic signal, the output signals at the outputs 2, 4 and 6 assume the following vector components after normalizing by the square root of three

| | | |
|---|---|---|
| exp (j120) | 1 | 1 |

-continued

| | | |
|---|---|---|
| 1 | exp (j120) | 1 |
| 1 | 1 | exp (j120) |

The foregoing matrix is a convenient way of expressing the transfer function of the multipole coupler of FIG. 2. If one thinks of the three outputs as a vector (or the three inputs) as a vector, then the rows of the matrix represent the state of the three output signals or vector components when one of the inputs is excited by a unit amplitude wave, where each output signal is represented by subvector having real and imaginary components. That is, when input 1 is excited by a unit-amplitude, periodic signal, the corresponding output signals on outputs 2, 4 and 6 are as specified in the first row of the matrix, respectively, where a 1 represents a subvector with a unit real component and a zero amplitude imaginary component and where the term "exp (j120)" represents a subvector with a zero amplitude real component and an imaginary component having an amplitude equal to exp (j120). Likewise, for a unit amplitude input signal at input 3, the output vector is comprised of three subvectors at outputs 2, 4 and 6, respectively, having real and imaginary component values as shown on row two of the matrix. A similar analysis pertains for a unit amplitude periodic signal applied to input 5 which causes an output vector having the three subvector components specified on row three of the matrix. In general, the way the coupler of the invention works, is that an output signal appearing at any output (hereafter the "resulting signal") is orthogonal to the signals which would appear on the same output resulting from signals applied to each of the other two inputs. However, this does not contradict the fact that the output signals appearing at each of the other two outputs resulting from a single signal applied to one of the inputs would be out of phase by 120 degrees relative to the resulting signal at any one of the other two outputs, Thus, the output signals are orthogonal to each other not with respect to output signals appearing simultaneously at two different outputs, but with respect to output signals appearing at the same output at different times when the signal applied to one input is shifted to another input.

Because of its essentially plane configuration, the component can be made using a wide variety of technologies, for example microstrip technology, stripline technology, circular, rectangular or square section coaxial line technology, or square coaxial line technology, also known as "bar line" technology.

Figure 3:
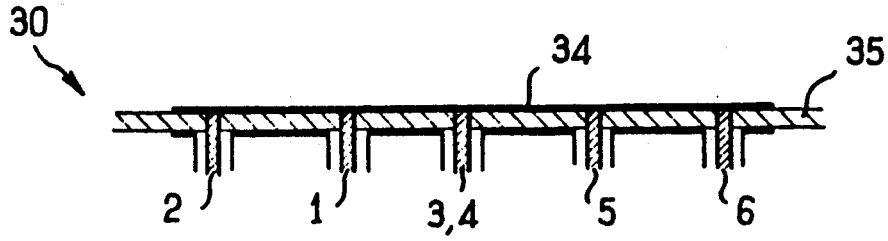
FIGS. 3 and 4 are section views through the FIG. 2 coupler when implemented using microstrip technology and stripline technology respectively.
Figure 4:
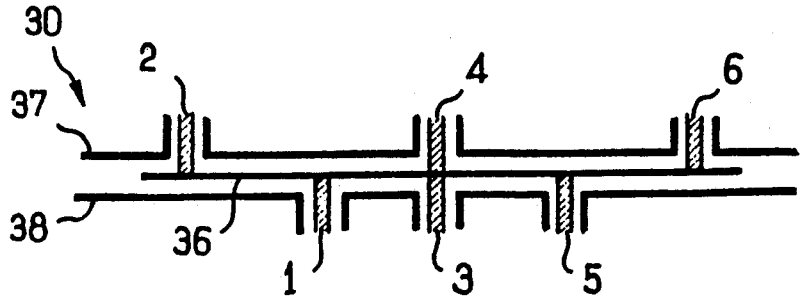

Thus, the section of FIG. 3 shows a microstrip embodiment with metallization 34 deposited on a substrate 35, whereas FIG. 4 shows a stripline embodiment with a central conductor 36 disposed between two ground planes 37 and 38.

For determining the dimensions and the characteristic impedances of the various line segments of the device, two typical configurations are described.

In the first embodiment, corresponding to the geometry of FIG. 2, all of the segments 31, 32, and 33 have the same characteristic impedance Zo as the input and outlet lines. The radial segments 31 are of lengths $\lambda/12$, the segments 32 are of length $\lambda/3$, and the segments 33 are of length $4\lambda/3$. Naturally, all these dimensions are given modulo $\lambda$.

Figure 5:
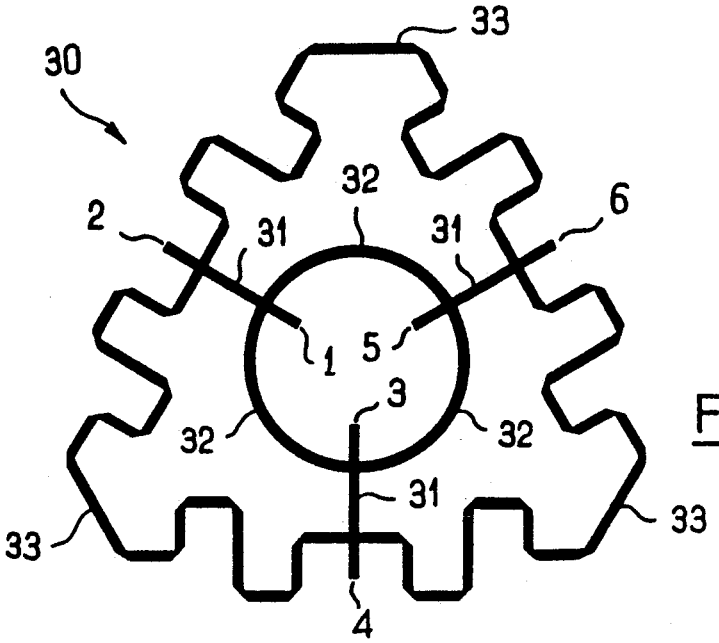
FIG. 5 is a plan view similar to FIG. 2 for a variant embodiment which is more particularly adapted to implementation using microstrip technology.

In a second embodiment corresponding to the configuration of FIG. 5, the radial segments 31 have a characteristic impedance Zo equal to that of the input and outlet lines, whereas the segments 32 and 33 of the inner and outer rings have a characteristic impedance equal to Zo/2. The radial segments 31 are of length 5λ/12 and the segments 32 and 33 of the inner and outer rings are of length λ/3. As shown in FIG. 5, it will be observed that it may be advantageous to lengthen the segments 33 of the outer ring by one or more wavelengths in order to avoid coupling between the inner and outer rings, in particular when using a microstrip embodiment (with a bar line embodiment this constraint is absent since the lines are closed and mutually decoupled).

Figure 6:
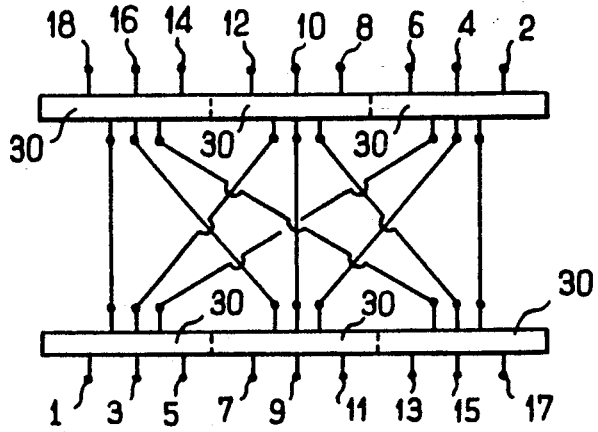
FIG. 6 shows one example of a 9×9 coupler implemented by combining a plurality of 3×3 couplers of the invention.
Figure 7:
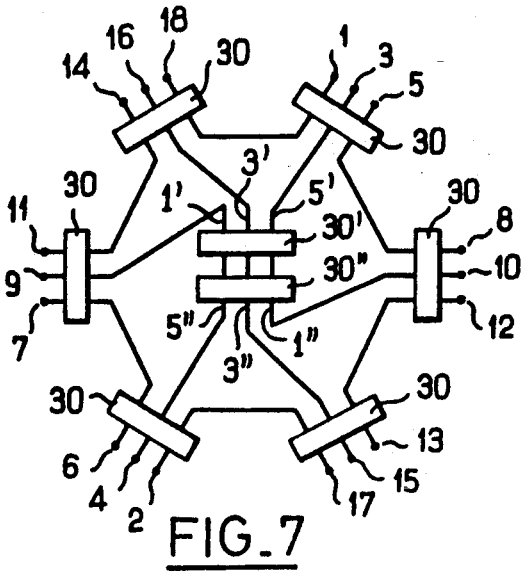
FIG. 7 shows a variant of FIG. 6 in which the inputs and the outputs of the elementary couplers are coupled together without any lines crossing over one another.
Figure 8:
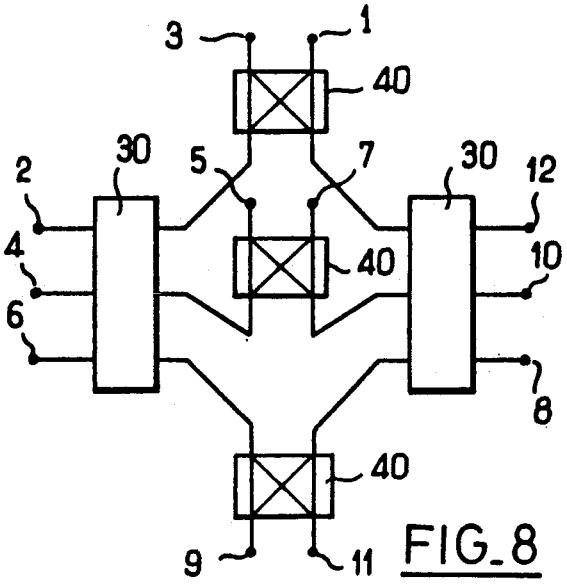
FIG. 8 shows an example of a 6×6 coupler made by combining 3×3 couplers of the invention with conventional type 2×2 couplers.

FIGS. 6 to 8 show embodiments of generalized couplers having a number of inputs and outputs greater than three and obtained by combining 3×3 couplers of the type described above (FIG. 4). The way in which two couplers are combined together is well known in the art, and is described in detail in the above-mentioned article by Shelton and Kelleher, for example. These generalized couplers are therefore described below very briefly.

Thus, FIG. 6 shows a 9×9 coupler having eighteen ports referenced 1 to 18 and implemented by combining six elementary 3×3 couplers referenced 30.

If it is desired to avoid cross-overs between the lines interconnecting the inputs and outputs of the various elementary couplers 30, a configuration as shown in FIG. 7 may be selected which is particularly suitable for an embodiment that is entirely plane (e.g. using microstrip technology). To avoid lines crossing over one another, two additional 3×3 couplers 30' and 30'' are provided connected back-to-back such that the signal applied to the port 1' reappears at the port 1'', the signal applied to the port 3' reappears at the port 3'', etc., and vice versa.

With such a generalized coupler configuration as shown in FIG. 6 or 7, a signal applied to any one of the inputs (i.e. any one of the odd numbered ports) reappears identically at all of the outputs (i.e. all of the even numbered ports) and vice versa.

FIG. 8 shows a 6×6 coupler constituted by combining two elementary 3×3 couplers of the invention referenced 30 with three conventional type elementary 2×2 couplers referenced 40. The conventional couplers serve to combine the various inputs 1 and 3, 5 and 7, and 9 and 11 in respective pairs, with the resulting signals then being applied to respective inputs of the two 3×3 couplers so that they reappear at all six outputs 2, 4, 6, 8, 10, and 12.

Clearly other configurations having a larger number of ports (e.g. 6×12, 9×18, 27×27, etc. couplers) can be built up using various combinations of 2×2, 3×3, and 4×4 couplers as described in the abovementioned article by Shelton and Kelleher.

There are numerous applications for such elementary or generalized couplers, including the following:

beam-forming arrays for multibeam contoured or non-contoured antennas, for observation or telecommunications satellites or for radars;

arrays for forming distance-measuring beams for satellite antennas, for mobile or stationary Earth stations, or for radars;

redundant systems, e.g. for telemetry and/or remote control antennas having a plurality of components (typically three or four) suitable for connection to a plurality of transmitter/receiver units by couplers of the invention;

multiple port amplifier systems enabling transmitter power to be distributed over a plurality of amplifiers, and enabling it to be distributed effectively with a certain degree of flexibility over a plurality of antenna beams or outputs; and more generally, any microwave distribution circuit, particularly, but not exclusively, for space applications.

We claim:

1. A six-port hybrid microwave coupler comprising three inputs and three outputs that are isolated and matched, where a signal applied to any one of the inputs produces signals on all three outputs that are orthogonally distributed in phase and uniformly distributed in amplitude;

the coupler having a plane- configuration of transmission lines comprising:

an inner ring comprising three similar segments with the interconnection points of said segments constituting three input or outlet first ports of the coupler;

an outer ring comprising three similar segments with the interconnection points of said segments constituting three outlet or input second ports respectively of said coupler; and three radial branches connecting the interconnection points of the inner ring segments to corresponding interconnection points of the outer ring.

2. A coupler according to claim 1, wherein for a guided wavelength of λ, and for lengths expressed in terms of modulo λ, with Zo being the characteristic impedance of the input and outlet lines:

the inner ring segments are of length λ/3 and of characteristic impedance Zo;

the outer ring segments are of length λ/3 or 4λ/3 and of characteristic impedance Zo; and the radial branches are of length λ/12 and of characteristic impedance Zo.

3. A coupler according to claim 1, in which additional radial branches are provided connecting the inner ring to the outer ring at points which are situated in intermediate regions between the respective interconnection points thereof.

4. A generalized hybrid microfrequency coupler having 3×N inputs and 3×M outputs which are isolated and matched, N and M being natural integers, in which a signal applied to any one of the 3×N inputs produces a uniform distribution of signals over the 3×M outputs, wherein for N and M greater than one, the coupler is constituted by a combination of a plurality of six-port couplers coupled by conventional 2×2 type couplers, and wherein each six-port hybrid microwave coupler is comprised of three inputs and three outputs that are isolated and matched, where a signal applied to any one of the inputs produces signals on all three outputs that are orthogonally distributed in phase and uniformly distributed in amplitude:

the six-port coupler having a plane configuration of transmission lines comprising:

an inner ring comprising three similar segments with the interconnection points of said segments constituting three input or output first ports of the coupler;

an outer ring comprising three similar segments with the interconnection points of said segments constituting three output or input second ports respectively of said coupler; and three radial branches connecting the interconnection points of the inner ring segments to corresponding interconnection points of the outer ring.

* * * * *